US005839387A

United States Patent [19]

Myklebust

[11] Patent Number: 5,839,387

[45] Date of Patent: Nov. 24, 1998

[54] ARRANGEMENT FOR SUPPORTING AND CONTROLLING A VEHICLE IN RELATION TO A CORRESPONDING TURRET

[75] Inventor: Erling Myklebust, Mykelbost, Norway

[73] Assignee: I.P. Huse A.S., Haroy, Norway

[21] Appl. No.: 793,742

[22] PCT Filed: Jul. 10, 1995

[86] PCT No.: PCT/NO95/00124

§ 371 Date: Mar. 26, 1997

§ 102(e) Date: Mar. 26, 1997

[87] PCT Pub. No.: WO96/06001

PCT Pub. Date: Feb. 29, 1996

[30] Foreign Application Priority Data

Aug. 19, 1994 [NO] Norway ..... 943078

[51] Int. Cl.[6] ..... B63B 21/00

[52] U.S. Cl. ..... 114/230

[58] Field of Search ..... 114/230, 293; 441/3–5; 166/355

[56] References Cited

U.S. PATENT DOCUMENTS 4,698,038 10/1987 Key et al. ..... 441/5

4,753,553 6/1988 Carlsen et al. ..... 114/230

5,372,531 12/1994 Boatman et al. ..... 114/230

FOREIGN PATENT DOCUMENTS 93007049 4/1993 WIPO ..... 114/293

*Primary Examiner*—Sherman Basinger

*Attorney, Agent, or Firm*—McAulay Nissen Goldberg Kiel & Hand, LLP

[57] ABSTRACT

A vessel is positioned relative to a turret moored to the sea bottom. The turning around of the vessel can occur in a controlled manner about a substantially vertical turret axis. The turret is supported in a defined region above the deck of the vessel by: a) a number of spring-loaded bearing systems; and b) by a number of pressure-regulatable locking systems. The vessel is supported for limited movement vertically and horizontally relative to the turret by a number of separate bearing systems which are arranged in pairs on diametrically opposite sides of the turret. Furthermore, the vessel is adapted to be locked by at least two opposite locking systems in regulatable positions about the turret axis.

24 Claims, 6 Drawing Sheets

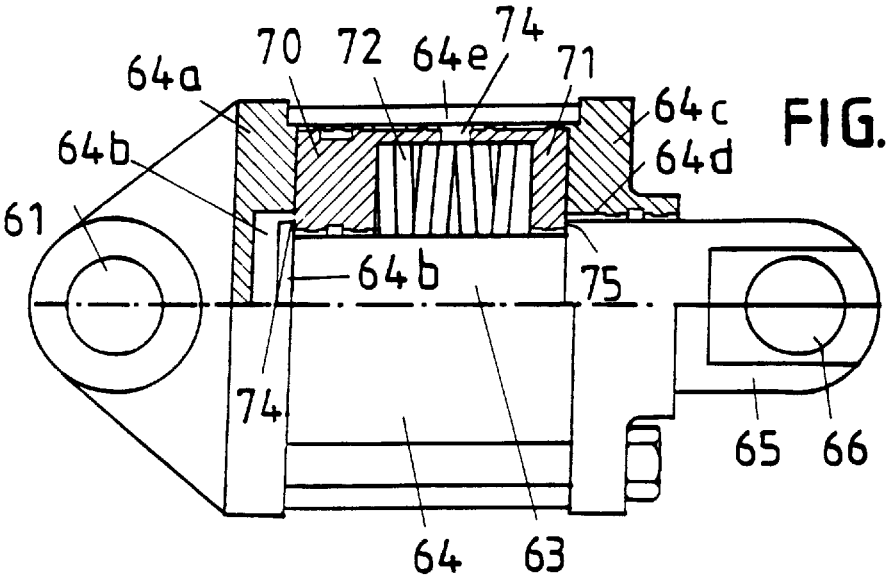
FIG. 12
FIG. 13
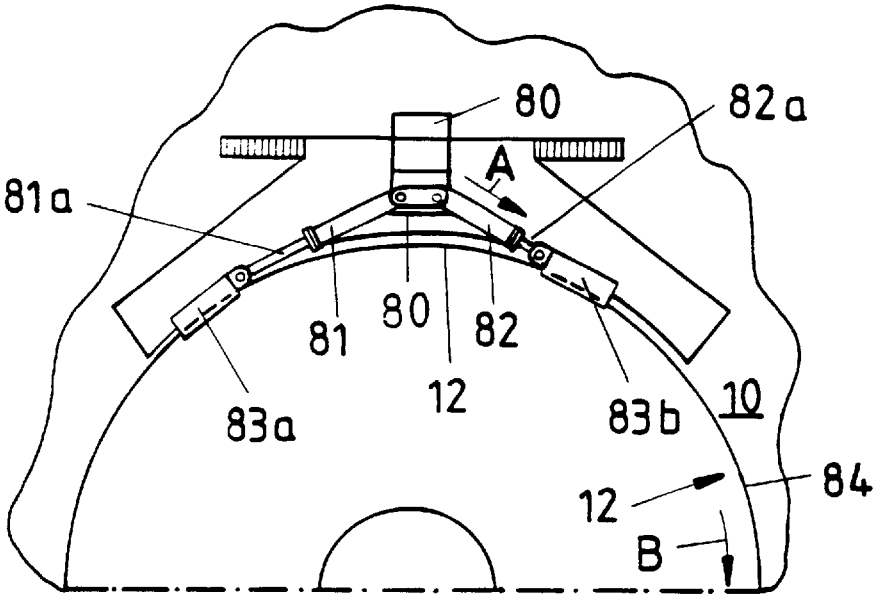
FIG. 14
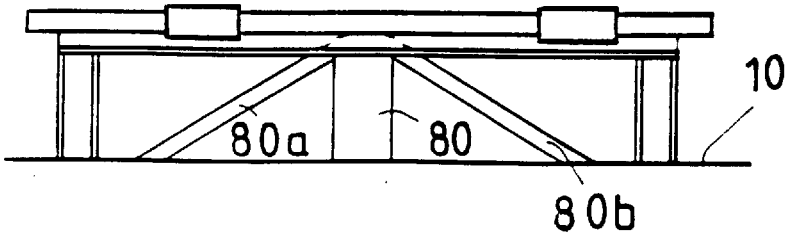

ARRANGEMENT FOR SUPPORTING AND CONTROLLING A VEHICLE IN RELATION TO A CORRESPONDING TURRET

Present invention relates to an arrangement for storing of a vessel relative to a turret moored to the sea bottom and for turning around the vessel in a controlled manner about a substantially vertical turret axis, where the vessel can be permitted a controlled minimal movement longitudinally of and transversely of the turret axis and where the vessel is adapted to be locked, by means of at least two opposite locking systems, in regulatable angular positions about the turret axis.

In NO 160 701 there is shown a solution as defined correspondingly above. There is illustrated and described an axial mounting and a radial mounting together with a safety mounting, with their respective pairs or sets of journals. There is consequently employed a mounting in three mutually separated zones with their respective sets of pressure-exerting means. Furthermore for each of the two main bearings, of the said three bearings, an active system is employed with position regulating means (hydraulic cylinders, pressure sensors, and the like), while for the third bearing a simpler arrangement is employed with yielding buffer members (of rubber).

A main object of the present invention is to provide an especially simple, totally passive suspension system, which is based on spring force.

Another object is aimed at absorbing combined forces in a concentrated region of the turret.

The arrangement according to the invention is characterized in that vertical and horizontal forces, which are transferred between vessel and turret, are adapted to be centered and relieved jointly in a limited region above the deck of the vessel in a support ring fastened to the peripheral surface of the turret via an annular series of separate spring-loaded bearing systems, which are fastened separately to the deck of the vessel, the support ring being slidably mounted in each bearing system in its respective bearing member, which is arranged in ring form in a single closed ring of bearing members.

According to the invention the horizontal and vertical forces can consequently be transferred between vessel and turret together, that is to say in concert, via a single series of bearing systems which are arranged in closed ring form around a cooperating, common support ring on the turret. By employing a single series of bearing members instead of two or more series of bearing members, the constructional support of the vessel in the turret is simplified and in addition the control is facilitated of the forces which act between the turret and the vessel. As to control it is especially favourable that the bearing members are mutually connected in closed ring form.

By employing separate, spring-loaded bearing systems according to the invention, an especially simple, but nevertheless operatively reliable, passive bearing system can be achieved. Consequently there can be avoided for one thing such extensive and complicated position regulating systems, as are proposed according to NO 160 701.

It is a particular advantage according to the invention that each bearing system comprises an axially movable piston-cylinder means, which at the one end is pivotally mounted in the bearing member and at the opposite end is pivotally mounted in a trestle fastened on the deck of the vessel, the piston-cylinder means being compressibly and extendably arranged in an axial direction, from a pressure-loaded starting position, against the force from oppositely acting pressure means (springs), while the piston-cylinder means is carried between the ends by a tension-transferring carrier means, which is arranged in a direction substantially at right angles to the axial direction of the piston-cylinder means.

According to the invention one can hereby achieve a favourable constructional solution by using pressure means in the form of springs, in that a first spring in the piston-cylinder means is employed as a counter-force against compression of the piston-cylinder means, while a second spring in the piston-cylinder means is employed as a counter-force against the extension of the piston-cylinder means. In addition a favourable coupling together is obtained of the forces which are transferred via the tension-transferring carrier means and the forces which are transferred by the piston-cylinder means itself.

All according to the object there can be employed according to the invention different types of spring means in the spring-loaded bearing systems, for example rubber springs, hydraulic springs, and the like, while in the illustrated, preferred embodiment spiral springs and one or more packs with cup springs have been employed.

According to the invention it is especially favourable to choose a spring characteristic which gives a sufficiently elastic yield ability in a normal position between ship and turret and which gives in addition a sufficiently powerful support effect on movement out from said normal position. It is important to avoid impurities in the support surfaces between the bearing systems and the turret and in order to avoid action between the said support surfaces it is important that there is constant contact between the support surfaces. This force which will ensure contact between the support surfaces ought to be small so that the main force which will prevent substantial movement between ship and turret will not be used up in ensuring contact between the support surfaces.

In this connection the arrangement is characterised in that the piston-cylinder means comprises a first spring system having a strongly increasing spring force and a second spring system having a relatively constant, low spring force.

It is preferred that the first spring system is made of a spring pack or of several spring packs of cup springs and that the second spring system is made of an elongate spiral spring.

There is a further advantage according to the invention that the piston-cylinder means comprises a spherical or part-spherical bearing portion designed at the one end of a piston member, the opposite end of which is axially displaceably received in a cylinder member, the spherical or part-spherical bearing portion together with an equivalently spherical internal bearing surface in the associated bearing member forming a pressure force-transferring universal joint connection between the piston-cylinder means and the actual bearing member.

Consequently it is possible according to the invention to transfer at the same time different forces which act in different directions in the support ring in a favourable manner to the universal joint-forming, spherical or part-spherical bearing portion in the piston-cylinder means.

The arrangement according to the invention is further characterised in that the bearing members are mutually connected to each other in a closed, relatively rigid ring form having a slidable or off-rollable supporting abutment in the support ring. The individual bearing members can hereby support each other to a significant degree locally in said relatively rigid ring form, at the same time as the bearing members are held securely in position in the support ring on the turret.

In this connection the bearing members can form a three-sided supporting abutment against the support ring or against a set of cooperating support rings, controlled by the relatively rigid ring form.

The spherical or part-spherical bearing portion of the bearing member can be designed in different ways, as is proposed in the following description.

In a first construction the bearing portion of the bearing member is shown in the form of a ball-like head portion, which is tiltably mounted in an associated block which is slidable sideways along opposite upper and lower slide surfaces in the support ring.

More specifically each bearing member can comprise a block which carries a set of mutually separated, slide means-forming support cushions, of which one or a pair of support cushions form a supporting abutment against a horizontal lower portion of the support ring and one or a pair of support cushions forming a supporting abutment against a horizontal upper portion of the support ring together with one or a pair of support cushions forming a supporting abutment against an intermediate vertical portion of the support ring.

In another construction the bearing portion is shown in the form of a support wheel which can be rollsed off along opposite upper and lower slide surfaces in the support ring.

In a preferred construction the support wheel can be rotatably mounted on the adjacent piston-cylinder means, in that the support wheel can have a laterally convexly curved peripheral surface which can be tiltable relative to an equivalent concavely curved, upper or lower slide surface in the associated support ring.

Alternatively the support wheel can have a substantially cylindrical peripheral surface, which can be rolled off against equivalent plane, upper and lower slide surfaces of associated support rings, in that a first wheel part of the support wheel can be tiltably mounted on a second wheel part, while the wheel parts can jointly be rotatably mounted on the piston member of the adjacent piston-cylinder means.

Further features of the present invention will be evident from the accompanying drawings, where there is shown a preferred embodiment and wherein:

FIG. 12 shows a cylinder which constitutes a part of the bearing members of the vessel.

FIG. 13 shows in part a plan view of a locking system according to the invention.

FIG. 14 shows the same as in FIG. 13 seen in side view.

Figure 1:
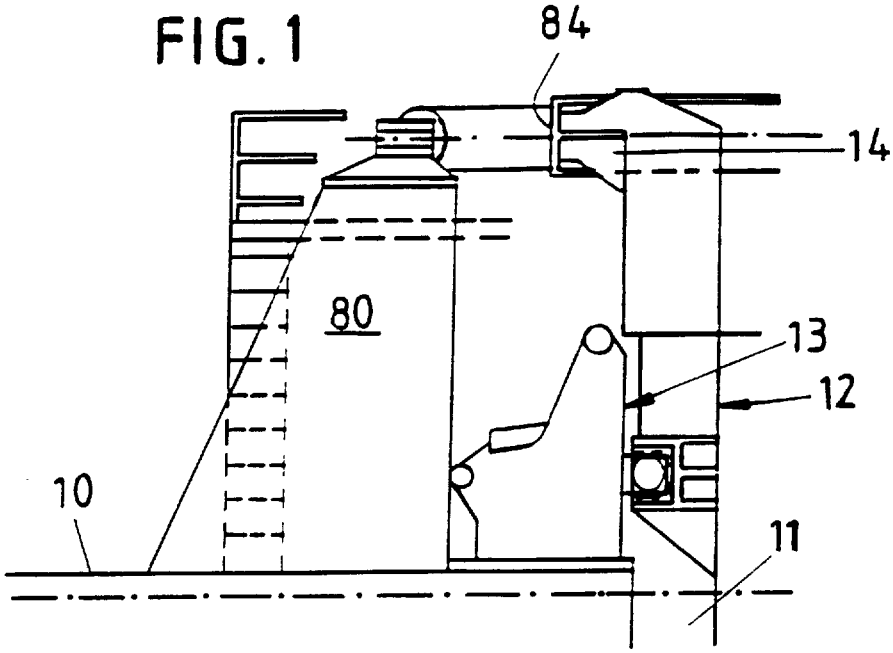
FIG. 1 shows in part a schematic side view of a bearing system and a cooperating locking system for a vessel, which can be moved in a controlled, restricted manner relative to a turret which is anchored to the sea bottom.
Figure 2:
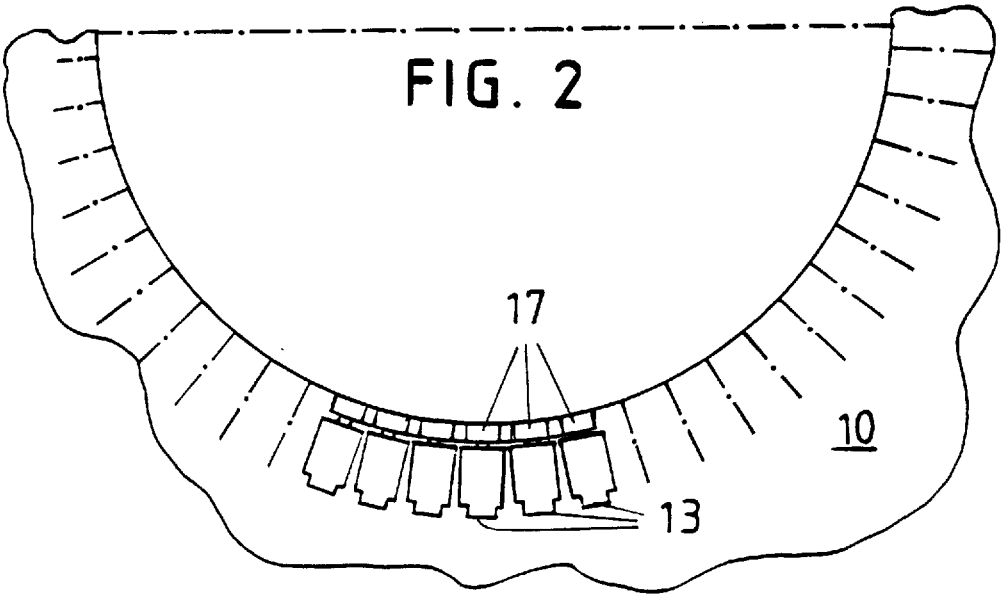
FIG. 2 shows in part a schematic plan view of a number of bearing systems arranged in annular series directly above the turret.

In FIG. 1 and 2 there is shown a section of upper deck 10 of a drilling vessel, which is provided with a vertical through-going, cylindrical passage 11 for reception of a turret 12.

The vessel, which is adapted to lie on the swing at. sea connected to the turret 12, is adapted to be turned around about the turret 12. The lower end of the turret 12 is connected in a manner, not shown, known per se with anchors fastened to the sea bottom via a number of anchor chains diverging obliquely outwards and downwards, for retaining the turret 12 in an exact position relative to the sea bottom.

The turret 12 is supported vertically and horizontally on the deck part 10 relative to vertical central axis 12*a* (FIG. 3) of the turret 12 by means of an annular series of bearing systems 13, which ensure that the drilling vessel can be anchored in an exact position relative to the turret 12. In addition to the bearing systems 13,' a regulatable locking system 14 is employed, which is adapted to lock the drilling vessel to the turret 12 in an established angular position about the vertical axis 12*a* of the turret 12 and is adapted to readjust the drilling vessel in steps between different angular positions relative to the vertical axis 12*a* of the turret 12.

Figure 3:
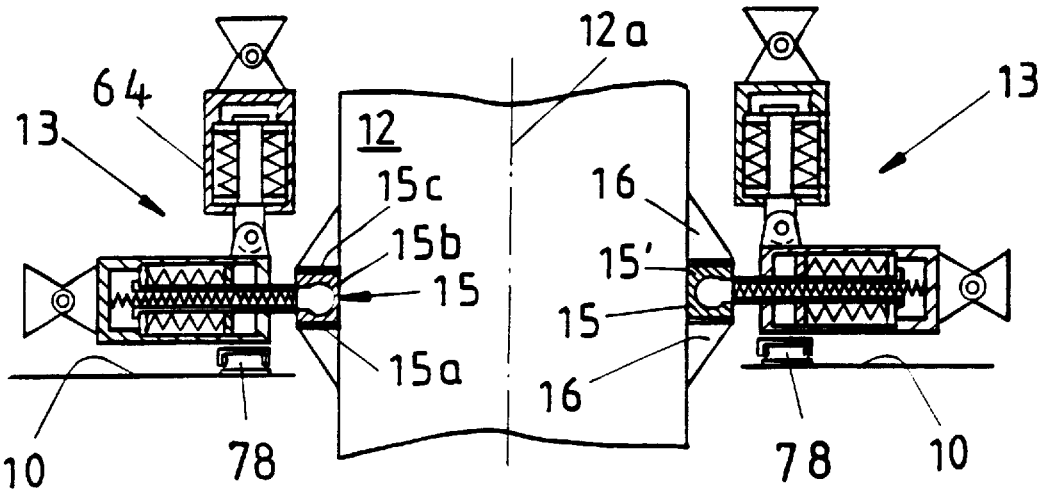
FIG. 3 shows in vertical section a schematic arrangement of two mutually opposite bearing systems.

In FIG. 3 there is shown a schematic arrangement of two mutually opposite bearing systems 13 of the turret 12. There is shown a duct-shaped cavity 15' in a support ring 15, which surrounds the turret 12 at a level just above deck part 10 of the drilling vessel. The support ring 15 is externally, that is to say above and below, reinforced and shored up against the turret 12 by means of triangular plates 16. The cavity 15' of the support ring 15 is provided with three machine-polished inner surfaces 15*a*–15*c*, which form slide surfaces for a number, for example fifty four bearing blocks 17, which are arranged in series in ring form, as is shown schematically in FIG. 2.

Figure 4:
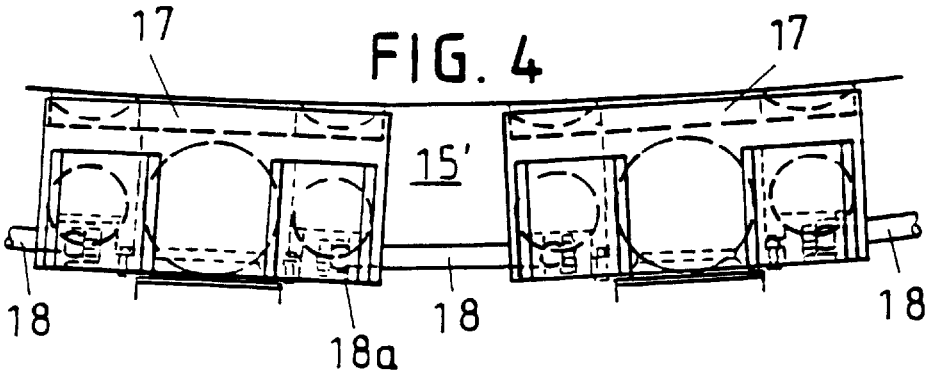
FIG. 4 shows details of the connection between bearing members of the vessel and equivalent bearing members of the turret.

In FIG. 4 there is shown a connecting means, in the form of a bolt 18, between each pair of blocks 17, so that the blocks 17 are held together in a closed, relatively rigid ring form and are thereby secured in place in the cavity 15' in the support ring 15. The bolt 18 is provided with opposite faces 18*a* (see FIG. 5) having a spherical support surface, which form supports against an equivalent seat ring 17*a* in the block 17. Between the face 18*a* and a locking nut 18*b* there is inserted a blade spring 18*c*.

Figure 5:
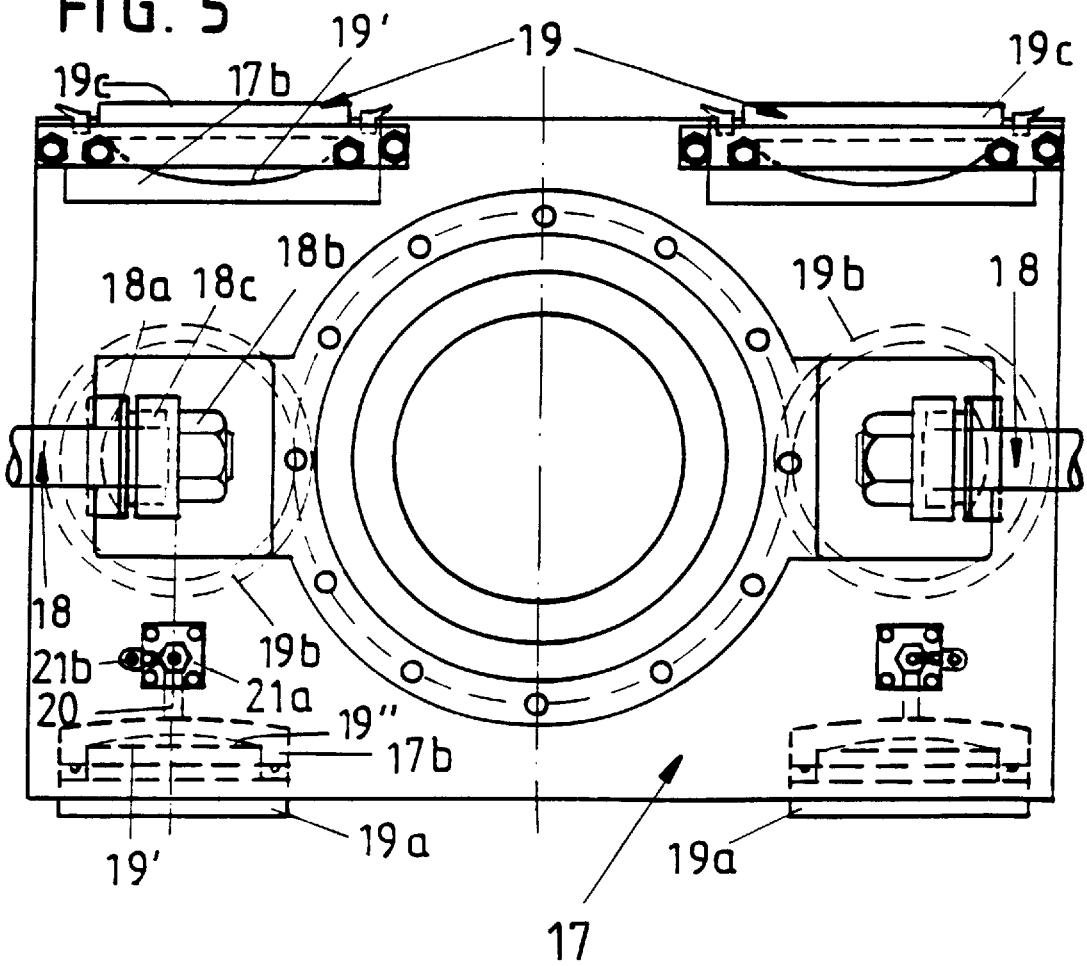
FIG. 5 shows an end view of a bearing block.
Figure 6:
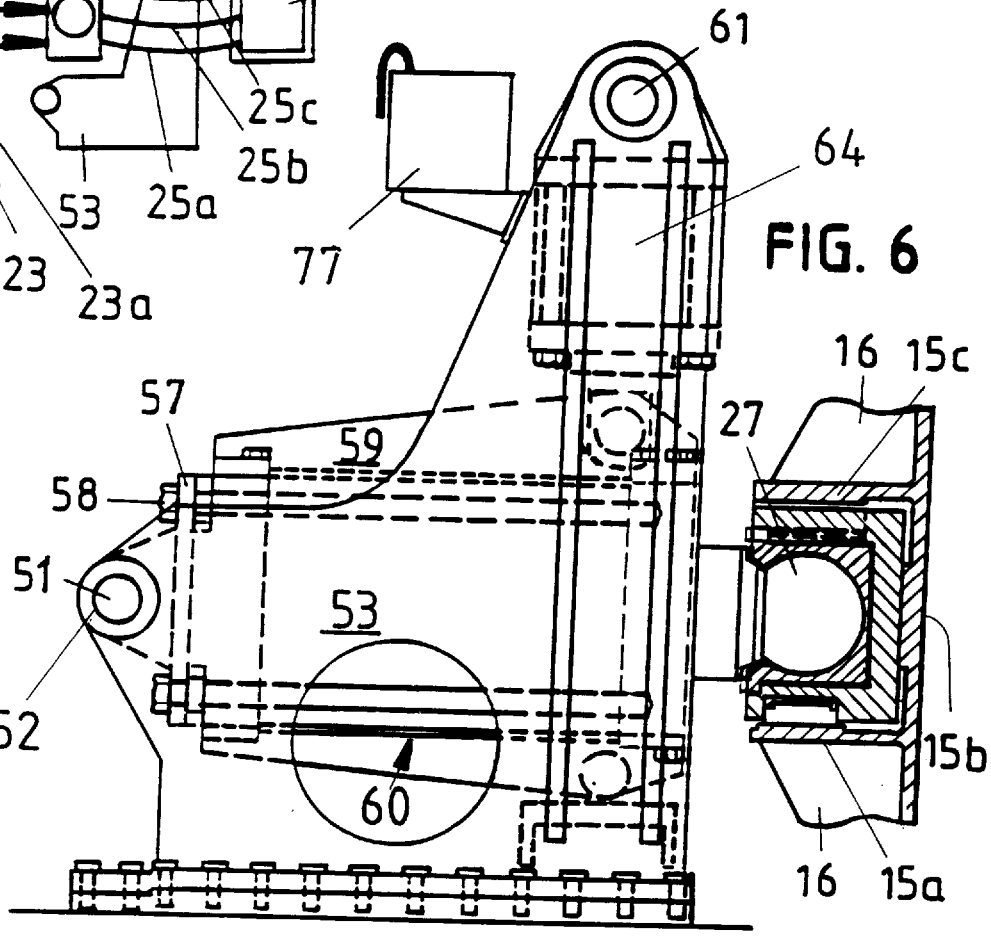
FIG. 6 shows a side view and in part a vertical section through cooperating bearing members of the vessel and of the turret.

In FIG. 4–6 there are shown six support cushions 19 in each block, that is to say two lower horizontally disposed support cushions 19*a*, which form abutments against the surface 15*a*of the support ring 15, and two central vertically disposed support cushions 19*b*, which form abutments against the surface 15*b* of the support ring 15, together with two upper horizontally disposed support cushions 19*c*, which form abutments against the surface 15*c* of the support ring 15. The support cushions 19 are provided with a spherical rounded off back surface 19' which can form a supporting abutment against an equivalent spherically rounded off support surface of a stop 17*b* of the block 17. In connection with each of the lower support cushions 19*a* there is shown a conduit connection 20 via a check valve 21*a* to a grease nipple 21*b*. Grease is pumped into an intermediate space between the non-curved back surface 19" of the support cushions 19*a* and the opposite, spherically curved support surface of the associated stop 17*b* of the block 17 until the support cushions 19*a* and 19*c* form a supporting abutment with a suitable resilience.

Figure 7:
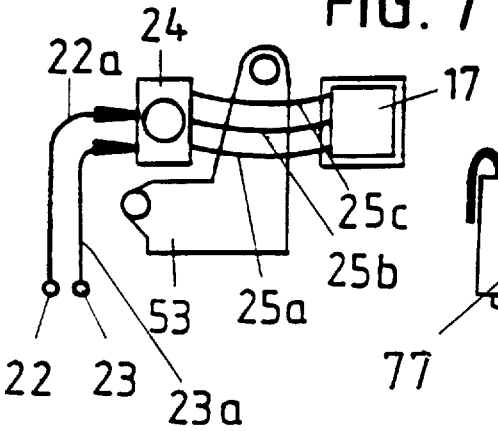
FIG. 7 shows schematically a system for the supply of grease to bearing members of the vessel.

In FIG. 7 there is schematically indicated a common system for lubrication of the support cushions 19 of the blocks 17. There is illustrated common feed conduit 22*a* for compressed air and feed conduit 23 for grease, with branch conduits 22*a* and 23*a* to a control means 24 and pressure medium pipes 25*a*–25*c* between the control means 24 and the associated block 17.

Figure 8:
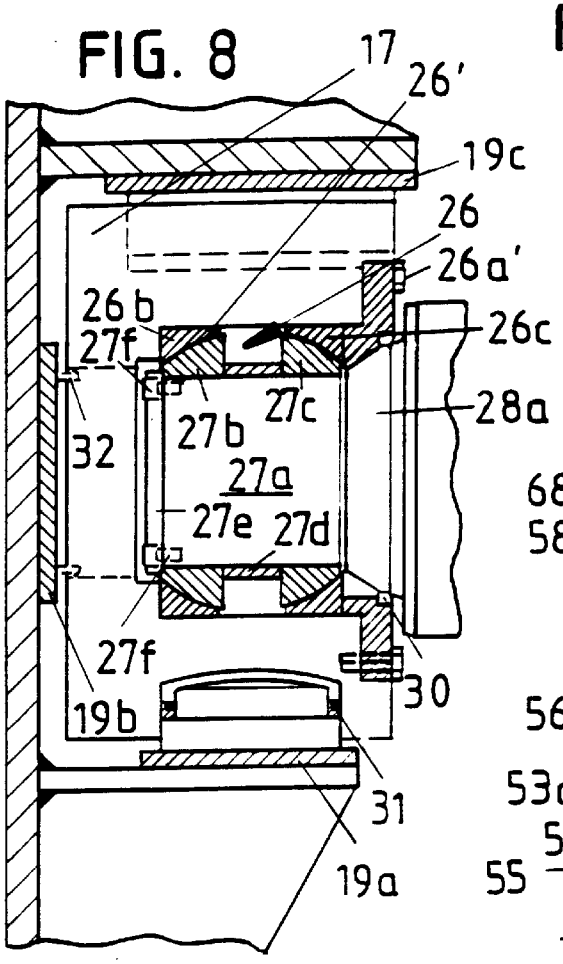
FIG. 8 shows in part another construction of bearing members of the vessel.

As shown in FIG. 8 a pivot bearing 26 having a spherical bearing surface 26' is received internally in the block 17, in an associated cavity in the latter. The pivot bearing 26 comprises a cover 26*a* which is fastened to the block 17 by means of fastening bolts 26*a*'. The bearing 26 surrounds a spherical head portion 27 (see FIG. 9) on the outer end of a piston 28 in a cylinder 29 (see also FIG. 6). The bearing 26 comprises an inner bearing ring 26*b* and an outer bearing ring 26*c*, while the head portion 27 comprises a nave portion 27*a*, an outer bearing ring 27*b* and an inner bearing ring 27*c* together with an intermediate distance ring 27*d*. The bearings 27*b*, 27*c* and the distance ring 27*d* are held in place on the nave portion 27*a* by means of an end plate 27*e* with associated fastening bolts 27*f*. As shown in FIG. 8 a sealing ring 30 is arranged between the cover 26*a* and a neck portion 28*a* on the piston 28 and a sealing ring 31 between the block 17 and each of the lower support cushions 19*a* together with a sealing ring 32 between the block 17 and one respectively of the remaining support cushions 19*b* and 19*c*.

The cylinder 29 and the associated piston 28 are shown further in FIG. 6 and 9–11. From FIG. 9 it is evident that in a bore 28' internally in the piston 28 there is received a helical spring 33, one end of which forms a stop against the piston 28 just by head portion 27 of the piston 28 and the opposite end of which forms a stop against a flange portion 34*a* on a first, internal spring holder 34. The spring holder 34 is pressure loaded by means of a compression spring in the form of a disc spring 35 and support ring 36 fastened to this, which is displaceable together with the compression spring 35 on a second spring holder 37 which forms a support against the bottom 29*a* of the cylinder 29.

Figure 9:
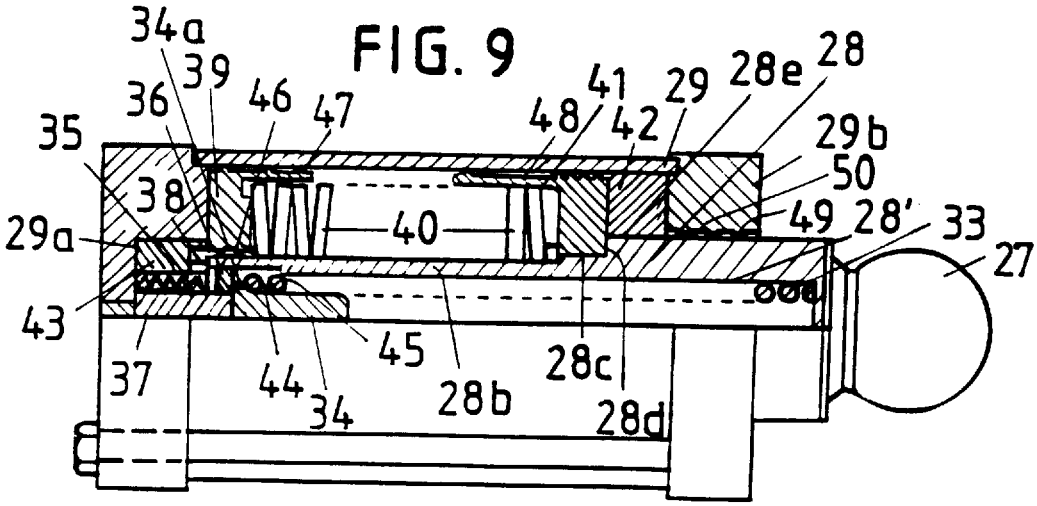
FIG. 9 shows in detail bearing members of the vessel, as illustrated in FIGS. 3, 6 and 7.

As shown in the upper part of FIG. 9 the inner end of the piston 28 is provided with a rim portion 38, which forms a stop for a first, radially outer spring holder 39 for a compression spring in the form of a disc spring 40 which surrounds the piston 28 on an inner portion 28*b* of least diameter. On an approximately middle portion 28*c* of average diameter there is fastened a second, radially outer spring holder 41 which forms a stop against a shoulder portion 28*d* between the middle portion 28*c* and an outer portion 28*e* of largest diameter. Between top 29*b* of the cylinder 29 and the spring holder 41 there is arranged a chamber 42 which allows pushing out of a limited length (for example 75 mm) of the piston 28 relative to the cylinder 29, against the force of the disc spring 40. Correspondingly in the bottom 29*a* of the cylinder 29 there is formed a cavity 43, which allows the piston 28 to be pushed inwardly into the cylinder a corresponding limited length (for example 75 mm), against the force of the disc spring 35 and the force of the helical spring 33. In addition a chamber 44 is defined between the support ring 36 and a shoulder portion 45 internally in the piston 28, the chamber 44 limiting the pushing in of the support ring 36 in the piston 28 by pushing in the piston 28 in the cavity 43. There are shown flow passages 46–49 between the various components which are arranged between the cylinder 29 and the piston 28. At 50 there is shown an O-ring for sealing off the piston 28 relative to the cylinder 29. There is formed a piston-cylinder means comprising the head portion 27, the piston member 28 and the cylinder member 29.

Figure 11:
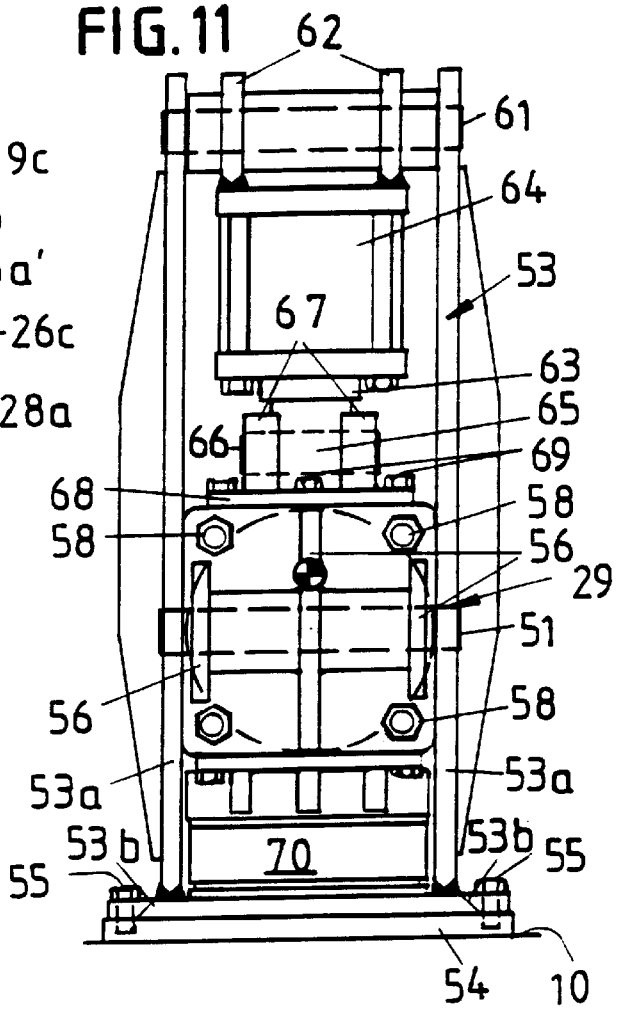
FIG. 10 and 11 show respectively a plan view and a vertical section of a block for fastening bearing members of the vessel to the deck of the vessel.
Figure 10:
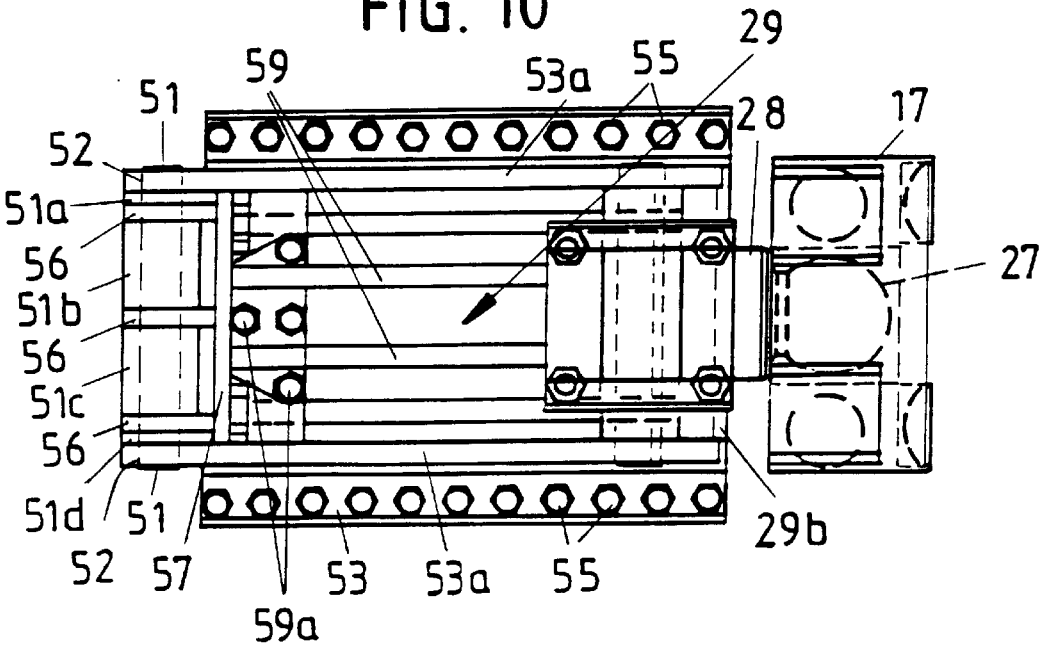

As shown in FIG. 6, 10 and 11 the rear end of the cylinder 29 is pivotally mounted about a pivot shaft 51 in pivot bearings 52 in a respective one of two opposite sides 53*a* in a trestle 53. Lower flange portion 53*b* of the trestle 53 is fastened to a bottom plate 54 on the deck portion 10 by means of a number of fastening bolts 55. As shown in FIG. 10 the pivot shaft is surrounded by a series of sleeve members 51*a*–51*d* and three intermediate ears 56. Together with the sleeve members 51*a*–51*d* the ears 56 are fastened to a plate member 57 which by means of bolts 58 is anchored in the top 29*b* of the cylinder 29. The cylinder 29 is provided with upper and lower, longitudinal bracing means 59,60 which are fastened to the cylinder with screw bolts as shown at 59*a*. At 53*c* longitudinal bracing means are shown on sides 53b of the trestle 53.

At the upper end of the trestle 53 there is pivotally mounted about a shaft 61 a pair of upper ears 62 in an upper end of a cylinder 64 in which a substantially vertically extending piston 63 is received. The piston 63 is provided at its lower end with a lower ear 65, which by means of a pivot shaft 66 is pivotally mounted in a pair of separately disposed ears 67 on a fastening plate 68 on the substantially horizontally extending cylinder 29. The fastening plate 68 is fastened to the cylinder 29 with screw bolts 69.

The cylinder 64 (see FIG. 12) comprises a top member 64*a* having a cavity 64*b* for the reception of the lower end of the piston 63 with associated upper rim portion 63*a* by sliding in of the piston 63 in the cylinder 64. Between top member 64*a* of the cylinder 64 and an opposite bottom member 64*c* with associated guide 64*d*, which is passed through by the piston 63, there is inserted a housing member 64*e*. Internally in the housing member 64*e* there are displaceably received two opposite spring holders 70,71 which form stops for an intermediate disc spring 72. Between the spring holders 70,71 there is defined a gap 73 which limits the possibility of compression for the disc spring 72. A shoulder portion 74 on the upper rim portion 64*b* of the piston 63 is adapted to press the upper spring holder 70 in a direction downwards towards the lower spring holder 71 by displacing the piston 63 downwards relative to the cylinder 64, while a lower shoulder portion 75 at the lower end of the piston 63 is adapted to press the upper spring holder 71 upwards towards the upper spring holder 70 on movement of the piston 63 upwards, that is to say inwardly into the cylinder 64.

The cylinder volumes of the cylinders 29 and 64 are filled with oil from an oil tank 77 arranged on top of the trestle 53, the separate conduit connections, not shown. further, leading respectively to one of the said cylinders.

By means of the substantially vertical cylinder 64 with associated piston 63 and associated disc spring 72 and by means of the substantially horizontal cylinder 29 with associated piston 28 and associated springs 33, 35, 40, which individually exert a certain tension force against the piston 28 the associated block 17 can be positioned in a specific starting position. By means of the annular series of fifty four blocks 17, which are positioned in pairs diametrically facing each other the drilling vessel can be positioned in a precise starting position relative to the central axis 12a of the turret 12, at the same time as the deck portion 10 of the drilling vessel is adjusted parallel to a common plane through the middle portion of the blocks 17, that is to say a common plane through the centre of the associated spherical piston head 27. By means of the inherent spring force (of the order of magnitude of 50–100 tons) in the cylinders 29, 64 of the individual blocks 17 significant movements can be compensated for between the turret 12 and the surrounding drilling vessel in a horizontal as well as in a vertical direction, with corresponding return positioning to the starting position immediately intermittently occurring forces between the turret 12 and the drilling vessel decrease. The spring force in each of the substantially vertical, dual acting cylinders 64 can for example correspond to +\–100 tons. On the deck portion 10 on the under side of the horizontal cylinder 29 there is placed a pressure-absorbing rubber block 78, which can absorb support pressures of for example 100 tons. Correspondingly the spring force in each of the substantially horizontal cylinders 29 can exert a spring force between for example about 0.5 ton in the starting position and about 100 tons in maximum loaded condition, the counter pressure being transferred via the trestle 53 and the bottom plate 54 to the deck portion 10.

The locking system 14 is shown in FIGS. 1, 13 and 14, the bearing system 13 being omitted in FIG. 13 and 14 for the sake of simplicity in order to make the locking system 14 clearer.

There is employed on the drilling vessel a front locking system and an equivalent (identical) rear locking system, of which only the one locking system 14 is shown in the drawings. Each locking system 14 comprises a supporting column 80 having two associated oblique supports 80*a* and 80*b*, which carries pivotally mounted the one end of two substantially oppositely directed hydraulic cylinders 81,82 with associated piston rods 81*a*, 82*a*, the outer end of which is pivotally mounted on its respective associated clamping means 83*a*, 83*b*. By exertion of a pressure in the cylinder, in a direction as shown by the arrow A, as shown in FIG. 13, the clamping means 83*b* is adapted to be forced to a tilted about position in order to be clamped in a clamping engagement about a T-shaped guide ring 84 (see FIG. 1) on top of the turret 12. The turret 12 is hereby secured in a permanent clamping engagement with the clamping means 83*b* in the retracted position of the piston rod 82*a*. In this position piston rod 81*a* of the remaining cylinder 81 is fully pushed out and the pressure in the cylinder 81 is relieved, something which involves the clamping means 83*a* being brought out of positive clamping engagement and being able to be freely displaced relative to the guide ring 84. By continued exertion of pressure in the cylinder 82 the turret 12 is forced to be swung about in the direction of the arrow B, until the piston rod 81*a* is fully pushed into the associated cylinder 81. The drilling vessel can meanwhile have turned an angle of for example 10° about axis 12*a* of the turret 12.

By first loading the cylinder 81 with pressure in a subsequent sequence, the clamping means 83*a* is brought into a permanent clamping engagement with the guide ring 84. Thereafter by relieving the pressure in the cylinder 82 the clamping means 83*b* is released from the clamping engagement with the guide ring 84 and the piston rod 82*a* can be pushed into the cylinder 82, the continued exertion of pressure in the cylinder 81. being adapted to force the drilling vessel to be turned by an angle of for example 10° about axis 12*a* of the turret 12 in said direction as shown by the arrow B. By alternately relieving pressure and loading with pressure the two cylinders 81,82, turning around of the drilling vessel can be effected to the desired position over the large angular arcs desired. During the turning around the pressure can if desired be regulated in the cylinders 81,82 with regulatable pressure so that full control of the turning around is achieved. In the desired angular position both cylinders can be set at the same holding pressure (lower than the operating pressure) so that both clamping means are individually pressed into a clamping engagement with the guide ring 84.

At the same time as turning of the vessel is effected about the turret axis 12*a*, by means of the regulatable locking systems 14, an effective control of the vessel can be ensured in vertical and horizontal directions relative to the turret axis 12*a* by means of a relatively large number of separate bearing systems 13. Under various conditions prevailing at sea, an effective examination and effective control of the forces which occur between vessel and turret can hereby be achieved, at the same time as an intended precise position of the vessel can be ensured at any time via the turret, based on simple and operatively reliable means (springs).

Figure 15:
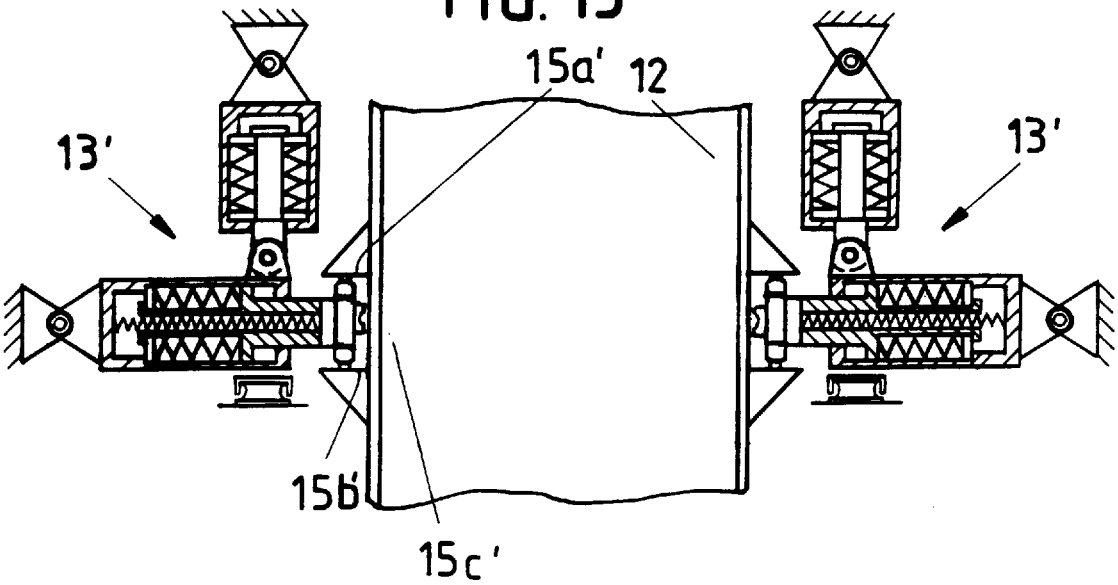
FIG. 15,shows in a vertical section corresponding to FIG. 3 a schematic arrangement of two mutually opposite bearing systems according to a second embodiment.

In FIG. 15 a second construction is shown of an arrangement, where the two mutually opposite bearing systems 13' of the turret 12 illustrated are constructed in broad outline corresponding to the bearing systems 13 as shown in FIG. 3.

Figure 16:
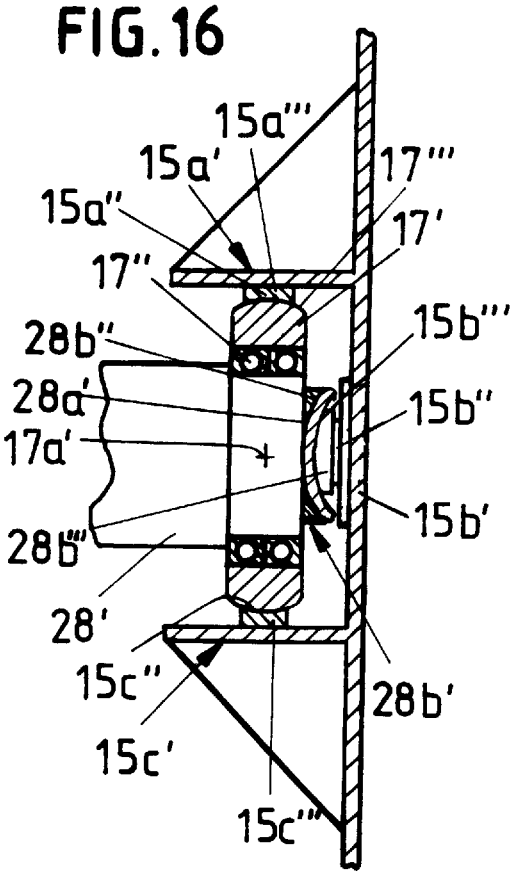
FIG. 16 shows in vertical section and in part details of the bearing system according to the second embodiment.

Further details of the illustrated second construction are shown on a larger scale in FIG. 16.

A first material departure consists in the support ring 15 according to FIG. 3, being replaced as shown in FIG. 15 and 16 by three separate support rings 15*a*', 15*b*' and 15*c*', which are secured individually to the turret 12. The upper ring 15*a*' and the lower ring 15*c*' are provided with their respective annular guide and support rail 15*a*" and 15*c*" each with its concave, that is to say part-spherically curved guide and support surface 15*a*'" and 15*c*'". The intermediate ring 15*b*' comprises a rail head portion 15*b*" with a convexly, that is to say part-spherically curved guide and support surface 15*b*'".

Furthermore the slidably mounted bearing member, which according to FIG. 3 is in the form of a block 17, is replaced according to FIG. 15 and 16 by a bearing member, which is in the form of a rim-shaped wheel or roller, which can be rolled off against mutually opposite support and guide surfaces 15*a*'", 15*c*'". The wheel or the roller 17' is rotatably mounted via ball bearings 17", which are fastened on a shaft journal on the piston member 28*a*. The wheel 17' is provided with a convexly curved, that is to say part-spherical support and guide surface 17'", which forms the rolling surface of the wheel 17' for rolling off against an equivalent part-spherical roller path surface of the support rails 15*a*" and 15*c*".

A second material departure consists in the piston member 28*a* of the piston-cylinder means itself carrying a support cushion 28*b*" having a concave, that is to say part-cylindrically curved guide and support surface 28*b*'", which endways forms a support abutment directly against the guide and support surface 15*b*'" of the rail 15*b*'.

The support cushion 28*b*" is tiltably mounted with a convexly curved back portion 28*a*' in a concavely curved support surface of a bed 28*b*" which is secured at the outer end of the piston member 28'. The wheel or the roller 17' is pivotable together with the piston member 28' about a horizontal axis 17*a*', which crosses the longi-tudinal axis of the piston member 28*a* in the centre of the wheel 17', for controlled turning around of the turret 12 about the axis 17*a*' via the guide and support surfaces 15*a*'" and 28*b*'" and 15*c*'" and 28*b*'" respectively. This controlled turning around of the piston member 28*a* can be compensated for in that the support cushion 28" can be tilted about relative to the guide and support surface 15*b*'" of the rail 15*b* and relative to the support surface 28*b*'" of the bed 28*b*".

Figure 17:
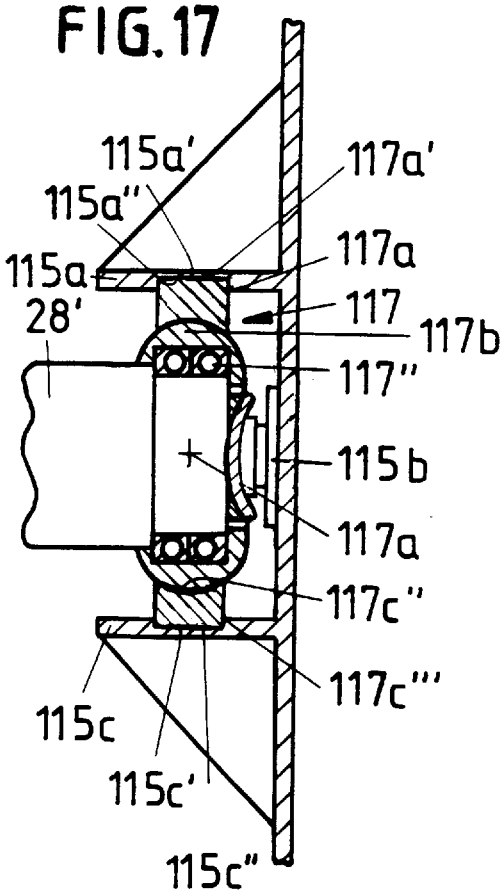
FIG. 17 shows in a corresponding vertical section to FIG. 16 a part of a bearing system according to a third embodiment.

A third construction is shown in detail in FIG. 17. In this case, instead of the separate rails 15*a*' and 15*c*' according to FIG. 16, there is arranged in the support ring 115*a* and in the support ring 115*c* an annular guide groove 115*a*' and 115*c*', which extends parallel to the respective support ring 115*a* and 115*c*. Furthermore a rim-shaped wheel 117 is provided with a first rim-shaped wheel member 117*a* having a cylindrical outer roller surface 117*a*', which can be rolled off against an equivalent support surface 115*a*" and 115*c*" of the support rings 115*a* and 115*c*. In addition the wheel 117 comprises a second rim-shaped wheel member 117*b* which is rotatably mounted via ball bearings 117", which are fastened on a shaft journal 128 on the piston member 28'. The two co-operating wheel members 117*a* and 117*b* are mutually tiltable about a horizontal axis 117*a*' correspondingly as explained in connection with the construction according to FIG. 16, in that the wheel members are provided with equivalent convexly and concavely curved, part-spherical support and guide surfaces as shown at 117*c*" and 117*c*'". The end support of the piston member in the support ring 115*b* is correspondingly as shown for the support ring 15*b*' in FIG. 16.

I claim:

1. Arrangement for positioning a vessel relative to a turret (12) moored to the sea bottom and for turning the vessel around in a controlled manner about a substantially vertical turret axis (12*a*), where the vessel can be permitted a controlled minimal movement longitudinally of and transversely of the turret axis (12*a*) by means of a number of separate actuating means which are supported on the vessel and which are arranged in series along the periphery of the turret and where the vessel is adapted to be locked, by means of at least two opposite locking systems (14), in regulatable angular positions about the turret axis (12*a*), characterised in that vertical and horizontal forces, which are transferred between vessel and turret (12), are adapted to be centred and relieved jointly in a defined region above the deck (10) of the vessel in a support ring (15; 15*a*',15*b*',15*c*') fastened to the peripheral surface of the turret (12) via an annular series of separate, spring-loaded bearing systems (13), which are fastened individually to the deck (10) of the vessel, the support ring (15;15*a*',15*b*',15*c*') being slidably and tiltably mounted in the bearing systems (13) by means of their respective bearing members (17,17',117), which are arranged in ring form into a single ring of bearing members (17,17',117).

2. Arrangement in accordance with claim 1, characterised in that the bearing members (17,17',117) are mutually connected to each other in the form of a closed, relatively rigid ring, each bearing member (17,17',117) having a supporting abutment in the support ring (15, 15*a*', 15*b*', 15*c*') separately slidable or able to be rolled off.

3. Arrangement in accordance with claim 1, characterised in that each bearing system (13) comprises an axially movable piston-cylinder-means (27–29), which at the one end has a bearing Portion (27) which is tiltably mounted relative to support surfaces in the support ring (15; 15*a*', 15*b*', 15*c*') and at the opposite end (at 51) is tiltably mounted in a trestle (53) fastened on the deck (10) of the vessel, the piston-cylinder-means (27–29) being compressibly and extendably arranged in an axial direction, from a pressure-loaded starting position, controlled by the force from oppositely acting pressure means (springs 35,40).

4. Arrangement in accordance with claim 3, characterised in that the piston-cylinder-means (27–29) comprises a first spring system having a strongly rising spring force and a second spring system having a relatively constant, low spring force.

5. Arrangement in accordance with claim 4, characterised in that the first spring system is made of a spring pack or several spring packs of cup springs and the second spring system is made of an elongate helical spring.

6. Arrangement in accordance with claim 3, characterised in that the piston-cylinder means (27–29) comprises: a first spring (40), which is arranged externally on the piston member (28) and which by means of the spring force ensures the piston member (28) in place in a position pushed inwards into the cylinder member (29), and a second spring (35), which is arranged in a bore (28') internally in the piston member (28) and which by means of the spring force is adapted to press the piston member in a direction outwardly from the cylinder member (29) against the force from the first spring (40), together with a third spring (33), which is arranged in said bore (28') internally in the piston member (28), a first spring holder (34), which is arranged in said bore (28') between the second spring (35) and the third spring (33), being adapted to effect a limited length of movement in said bore (28') against the force from the third spring, while a second spring holder (39) for the first spring (40) is adapted to effect a limited length of movement internally in the cylinder member (29) against the force from the first spring (40), guided by a rim member (38) on the piston member (28).

7. Arrangement in accordance with claim 3, characterised in that the piston-cylinder-means (27–29) is carried in a region between the ends by a tension-transferring carrier means (64), which is arranged in a direction substantially at right angles to the axial direction of the cylinder means (27–29).

8. Arrangement in accordance with claim 3, characterised in that a bearing portion (27) of the piston-cylinder-means (27–29), which is provided with a spherical or part-spherical support surface, together with a co-operating spherical or part-spherical support and guide surface, which is directly or indirectly connected to the support ring (15; 15*a*', 15*b*', 15*c*'), forms a pressure force transferring universal joint connection between said bearing portion (27) of the piston-cylinder-means (27–29) and the support ring (15; 15*a*', 15*b*', 15*c*').

9. Arrangement in accordance with claim 8, characterised in that the pressure force-transferring universal joint connection is formed by the spherical bearing portion (27) together with an equivalent spherical internal support and guide surface of an associated rim-shaped bearing member (17), which is slidably mounted in the support ring (15; 15*a*', 15*b*', 15*c*').

10. Arrangement in accordance with claim 8, characterised in that the pressure force-transferring universal-joint connection is formed by a peripheral surface on a support wheel (17',117), which is rotatably mounted on a piston member (28*a*), together with an equivalent support and guide surface of the support ring (15*a*', 15*b*', 15*c*').

11. Arrangement in accordance with claim 10, characterised in that the support wheel (17') has a part-spherical peripheral surface (17'") which is convexly curved and forms a supporting abutment against a concavely curved support and guide surface of an upper and a lower support ring (15*a*', 15*c*').

12. Arrangement in accordance with claim 10, characterised in that the support wheel (117) comprises a rim-shaped outer wheel member (117*a*), which can be rolled off against an equivalent support and guide surface (115*a*', 115*c*') of the support ring (115*a*, 115*c*) and which has a part-spherical, concavely curved inner peripheral surface (117*c*'") which forms a tiltable supporting abutment against a convexly curved outer peripheral surface (117*c*") on an inner wheel member (117*b*) which is rotatably mounted on a shaft journal (128) on the piston member (28').

13. Arrangement in accordance with one of the claims 10–12, characterised in that the support wheel (17',117) forms a two-sided supporting abutment against a support and guide surface of an associated upper and lower support ring (15*a*', 15*c*') respectively, the piston member (28*a*) forming a separate supporting abutment against a separate support and guide ring (15*b*') independently of the support wheel (17',117).

14. Arrangement in accordance with claims 3, characterised in that rim-shaped bearing members (17) form three-sided supporting abutments against the support ring (15), guided by the relatively rigid ring shape mutually between the bearing members (17), each bearing member (17) being provided with a set of mutually separated, slide means-forming support cushions (19), of which one or a pair of support cushions (19*a*) forms a supporting abutment against a horizontal lower portion of the support ring (15) and one or a pair of support cushions (19*c*) forms a supporting abutment against a horizontal upper portion of the support ring (15) together with one or a pair of support cushions (19*b*) forming a supporting abutment against an intermediate vertical portion of the support ring (15).

15. Arrangement in accordance with claim 14, characterised in that the support cushions (19*a*–19*c*) are supplied for their respective rear sides with lubricant under pressure from a common control means (24) via associated pressure medium conduits (25*a*–25*c*).

16. Arrangement in accordance with claim 3, characterised in that the piston-cylinder-means (27–29) comprises a cylinder member (29), which at its one end is pivotally mounted about a first horizontal pivot shaft (51) in one, lower end of the trestle (53) and at its opposite, other end is pivotally-mounted about a second horizontal pivot shaft (61) in the other, upper end of the trestle (53), a carrier means (64), which is inserted between the upper end of the trestle (53) and the lower lying other end of the piston-cylinder means (27–29), forming an intermediate, tension-transferring link connection between the piston-cylinder means (27–29) and the trestle (53).

17. Arrangement in accordance with claim 16, characterised in that on the deck (10) of the vessel, just below the carrier means (64), that is to say on the under side of the piston-cylinder-means (27–29), a pressure-absorbing support rim (78) is arranged for the support of said other end of the piston-cylinder-means (27–29) in continuation of the carrier means (64).

18. In combination, a vertically disposed turret for anchoring to a sea bottom;

a vessel having a cylindrical passage receiving said turret and a deck extending around said turret;

a support ring secured to and peripherally about said turret;

a plurality of bearing members disposed peripherally within said ring;

an annular series of bearing systems secured to said deck, each bearing system being pivotally connected to a respective one of said bearing members to connect said vessel to said turret and being spring biased radially into said respective one of said bearing members to permit tilting of said vessel relative to said turret; and a plurality of bolts, each bolt connecting an adjacent pair of said bearing members to each other to form said plurality of bearing members into a rigid ring form within said support ring.

19. In combination, a vertically disposed turret for anchoring to a sea bottom;

a vessel having a cylindrical passage receiving said turret and a deck extending around said turret;

a support ring secured to and peripherally about said turret;

a plurality of bearing members disposed peripherally within said ring; and an annular series of bearing systems secured to said deck, each bearing system being pivotally connected to a respective one of said bearing members to connect said vessel to said turret and being spring biased radially into said respective one of said bearing members to permit tilting of said vessel relative to said turret; one of said bearing members including a block disposed within said support ring, a pair of vertically disposed support cushions on a front surface of said block abutting a vertical wall of said support ring, a pair of horizontally disposed support cushions on a bottom surface of said block abutting a first horizontal wall of said support ring and a pair of horizontally disposed support cushions on an upper surface of said block abutting a second-horizontal wall of said support ring.

20. The combination as set forth in claim 19 wherein each support cushion is mounted on a respective hemispherical support surface in said block to slide thereon.

21. In combination, a vertically disposed turret for anchoring to a sea bottom;

a vessel having a cylindrical passage receiving said turret and a deck extending around said turret;

a support ring secured to and peripherally about said turret;

a plurality of bearing members disposed peripherally within said ring, at least one of said bearing members being a roller disposed within said support ring and having a part-spherical surface rollably mounted on a part spherical surface on two opposite sides of said support ring; and an annular series of bearing systems secured to said deck, each bearing system being pivotally connected to a respective one of said bearing members to connect said vessel to said turret and being spring biased radially into said respective one of said bearing members to permit tilting of said vessel relative to said turret.

22. In combination, a vertically disposed turret for anchoring to a sea bottom;

a vessel having a cylindrical passage receiving said turret and a deck extending around said turret;

a support ring secured to and peripherally about said turret;

a plurality of bearing members disposed peripherally within said ring; and an annular series of bearing systems secured to said deck, each bearing system being pivotally connected to a respective one of said bearing members to connect said vessel to said turret and being spring biased radially into said respective one of said bearing members to permit tilting of said vessel relative to said turret;

at least one of said bearing members being a wheel having a cylindrical surface rollably mounted on two opposite sides of said support ring, said wheel having an inner part spherical surface mounted on a part spherical surface of a respective bearing system.

23. In combination, a vertically disposed turret for anchoring to a sea bottom;

a vessel having a cylindrical passage receiving said turret and a deck extending around said turret;

a support ring secured to and peripherally about said turret;

a plurality of bearing members disposed peripherally within said ring; and an annular series of bearing systems secured to said deck, each bearing system being pivotally connected to a respective one of said bearing members to connect said vessel to said turret and being spring biased radially into said respective one of said bearing members to permit tilting of said vessel relative to said turret, at least one of said bearing systems including a piston having a head portion received in a respective one of said bearing members, a spring biasing said piston towards said respective bearing member and a housing slidably receiving said piston, said housing being pivotally mounted at an end opposite said head portion on said deck to pivot about a horizontal axis.

24. The combination as set forth in claim 23, which farther comprises a vertically disposed cylinder having a reciprocally mounted piston pivotally connected to said housing of said one bearing system for pivoting said housing about said horizontal axis.

* * * * *